US005538021A

United States Patent [19]

Kim

[11] Patent Number: 5,538,021

[45] Date of Patent: Jul. 23, 1996

[54] HAIR WINDER FOR PERMANENT WAVES

[75] Inventor: Hyeong S. Kim, Kowloon, Hong Kong

[73] Assignee: Georg Wiegner, Kowloon, Hong Kong

[21] Appl. No.: 284,095

[22] Filed: Aug. 1, 1994

[30] Foreign Application Priority Data

Aug. 9, 1993 [DE] Germany ..... 9311823

[51] Int. Cl.[6] ..... A45D 2/00

[52] U.S. Cl. ..... 132/222; 132/245

[58] Field of Search ..... 132/222, 226, 132/245, 262, 210

[56] References Cited

U.S. PATENT DOCUMENTS

| | | | |
|---|---|---|---|
| Re. 27,033 | 1/1971 | Mitsumoto . | |
| T871,055 | 7/1969 | Freeman . | |
| 1,718,025 | 6/1929 | Bishinger | 132/222 X |
| 1,994,099 | 3/1935 | Fulton | 132/222 |
| 2,166,386 | 7/1939 | Auster . | |
| 2,171,885 | 9/1939 | Michael | 132/210 |
| 2,331,065 | 11/1939 | Willat . | |
| 2,404,517 | 7/1946 | Molchan . | |
| 2,631,593 | 3/1953 | Madore | 132/222 |
| 2,708,941 | 5/1955 | Field . | |
| 2,747,585 | 5/1956 | Allen et al. . | |
| 2,825,344 | 3/1958 | Lenois . | |
| 2,838,053 | 6/1958 | Zimmerman . | |
| 2,874,706 | 2/1959 | Ficicchy . | |
| 2,941,534 | 6/1960 | Otto et al. . | |
| 2,972,994 | 2/1961 | Ferens . | |
| 3,045,685 | 7/1962 | Cormier . | |
| 3,105,502 | 10/1963 | Mitchell . | |
| 3,106,213 | 10/1963 | Clare . | |
| 3,123,080 | 3/1964 | Albertoni . | |
| 3,204,646 | 9/1965 | Chamberlin . | |
| 3,326,222 | 6/1967 | Rosenheim . | |
| 3,388,709 | 6/1968 | Morris . | |
| 3,530,863 | 9/1970 | Foster | 132/222 |
| 3,666,915 | 5/1972 | De Napoli . | |
| 3,700,853 | 10/1972 | Jensen et al. . | |
| 3,759,271 | 9/1973 | Caruso . | |
| 3,812,866 | 5/1974 | Morane . | |
| 3,881,500 | 5/1975 | Shinbashi et al. . | |
| 3,923,068 | 12/1975 | Gilman . | |
| 3,943,946 | 3/1976 | Gallegos | 132/39 |
| 4,298,787 | 11/1981 | Barradas . | |
| 4,431,012 | 2/1984 | Albertoni . | |
| 4,465,084 | 8/1984 | Fulgoni | 132/245 |
| 4,516,011 | 5/1985 | Jeffress et al. . | |
| 4,638,821 | 1/1987 | Smith | 132/222 X |

(List continued on next page.)

FOREIGN PATENT DOCUMENTS

| | | |
|---|---|---|
| 0197208 | 4/1985 | European Pat. Off. . |
| WO88/00445 | 1/1988 | European Pat. Off. . |
| 0460452 | 5/1991 | European Pat. Off. . |
| 1247508 | 11/1959 | France . |
| 1404587 | 5/1964 | France . |
| 2382212 | 3/1978 | France . |
| 2503996 | 4/1982 | France . |
| 2615079 | 11/1988 | France . |
| 1793426 | 2/1959 | Germany . |
| 1457375 | 3/1969 | Germany . |
| 1557333 | 1/1972 | Germany . |
| 2338330 | 2/1975 | Germany . |
| 7505892 | 10/1975 | Germany . |
| 2426028 | 12/1975 | Germany . |
| 2622364 | 12/1976 | Germany . |
| 2002226 | 2/1979 | Germany . |
| 3005837 | 9/1980 | Germany . |
| 3309241 | 3/1983 | Germany . |
| 3230357 | 2/1984 | Germany . |
| 3616076 | 11/1987 | Germany . |
| 1851705 | 11/1991 | Germany . |
| 426125 | 12/1966 | Switzerland . |
| 2192786 | 1/1988 | United Kingdom . |
| 88/00445 | 1/1988 | WIPO . |

*Primary Examiner*—John G. Weiss

*Attorney, Agent, or Firm*—Steven F. Caserza; Flehr, Hohbach, Test, Albritton & Herbert

[57] ABSTRACT

A hair winder having a winding member on which the hair can be wound, a strip of foil being so attached to the winding member that the strip can be wound onto the winding member together with the hair.

5 Claims, 2 Drawing Sheets

U.S. PATENT DOCUMENTS

| | | | |
|---|---|---|---|
| 4,687,010 | 8/1987 | Caruso . | |
| 4,699,159 | 10/1987 | Thaler . | |
| 4,771,797 | 9/1988 | Kosaka . | |
| 4,989,621 | 2/1991 | Keller | 132/245 |
| 5,007,443 | 4/1991 | Fulgoni | 132/270 |
| 5,117,090 | 5/1992 | Askins . | |
| 5,144,968 | 9/1992 | Rivera . | |
| 5,255,694 | 10/1993 | Caruso . | |
| 5,263,501 | 11/1993 | Maznik . | |
| 5,286,949 | 2/1994 | Simons . | |
| 5,309,930 | 5/1994 | Presser . | |

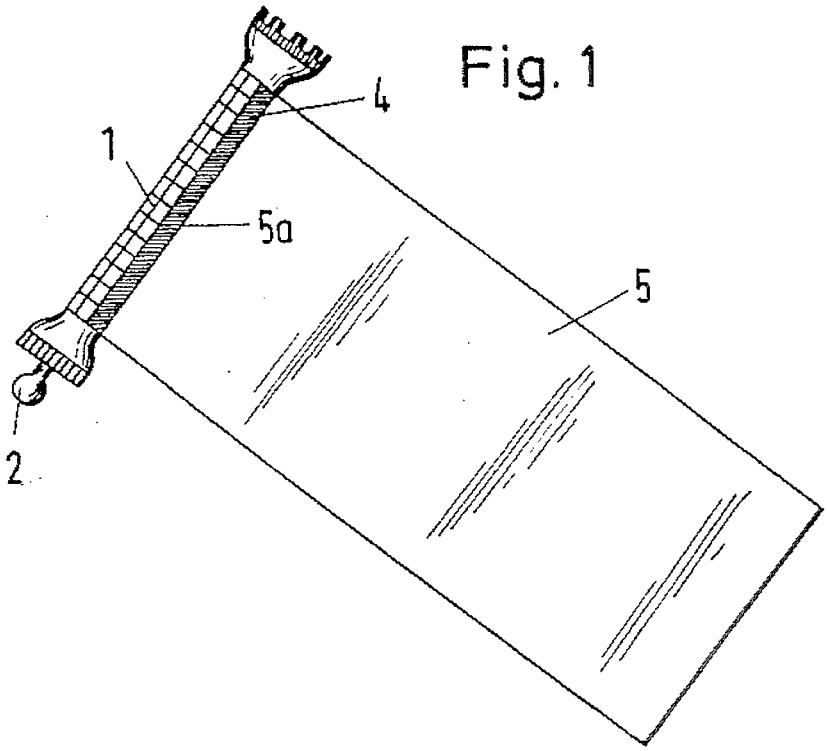
Fig. 1
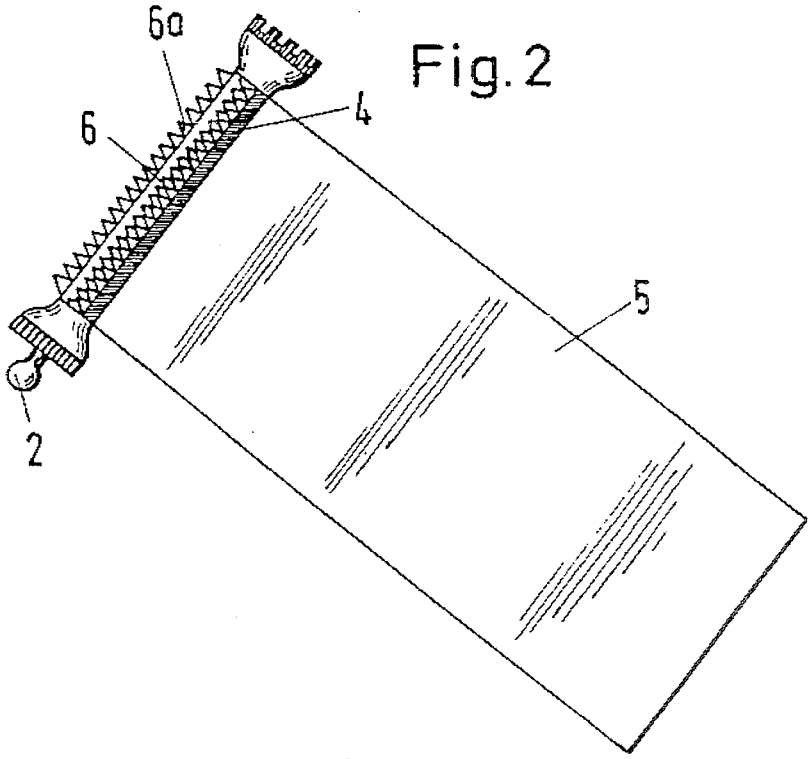
Fig. 2
Fig. 3
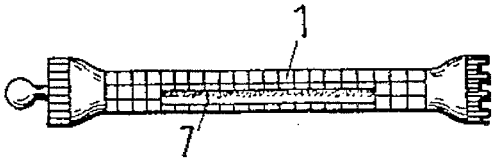

HAIR WINDER FOR PERMANENT WAVES

FIELD OF THE INVENTION

The present invention relates to a hair winder for permanent waving and, more particularly, to a hair winder including a spooling device and a foil strip attached thereto.

BACKGROUND OF THE INVENTION

Permanent waving is intended to set curls in the hair, making use of chemical agents which produce a softening of the cellular structure of the hair and thereafter fix the hair in an altered shape. Prior to the chemical treatment, the hair is usually wound onto very thin (5–16 mm) hair winders. The coiled hair is chemically fixed, so that on completion of the treatment the hair remains deformed in close curls, substantially corresponding to the close windings of the winder.

Such chemical treatment basically represents a heavy stressing of the keratinous cellular structure of the hair and may cause considerable damage to the hair if inexpertly performed. As the name indicates, permanently waved hair permanently maintains its deformation. It is possible to form tight curls (Negroid curls) or gentle soft curls. The decisive factor for the tightness of the curls is the diameter of the winders.

There is also the problem of the aftergrowth of hair which is of course untreated and of a varying degree of straightness. At the latest after approximately six months the difference between the permanently waved and untreated hair is visible and the aftergrowth of hair requires renewed treatment.

As already mentioned, every permanent wave treatment stresses the hair heavily. As far as possible, therefore, the pretreated hair must be protected against being subjected again to chemical stressing which may result in considerable permanent damage, such as splitting, brittleness, dry dullness—in brief, the impression of dead hair. The industry attempts to counteract such damage by the addition of protective substances to the permanent waving agents, since it has hitherto been virtually impossible to effectively separate prewaved and aftergrowth hair, which are of course wound together on a winder, in order to achieve treatment only of the aftergrowth with the chemical agents.

OBJECTS OF THE INVENTION

It is an object of the invention to improve a simple hair winder of the kind specified, which can readily be handled in the home, that only the area of hair aftergrowth is treated, the already pretreated zone of the hair being left alone.

Another object is to provide an improved hair winder which can be readily used even by unskilled individuals but which will be free from drawbacks of earlier devices.

SUMMARY OF THE INVENTION

These objects are attained according to the invention by providing the hair winder with a strip or foil so attached to the winding member or spooler that the strip can be wound onto the winding member together with the hair, something which greatly facilitates the winding-on of the hair tips. As winding continues, from free ends inside to the roots outside on the spooler, the hair automatically covered by the foil is protected, only the aftergrowth being accessible for treatment.

The permanent wave winder according to the invention represents a device which is simple and uncomplicated and which can be mastered not only by specialist hairdressers, but also by domestic users. The winder calls for no new technology and is used in precisely the same way as the prior art permanent wave winders. The diameters for obtaining tight or soft curls can also remain unchanged.

According to the invention, therefore, a strip of foil is attached to the prior art plastic winder which is preferably of the same width as the latter and whose length corresponds to the length of the pretreated hair which is to be protected against a repeated treatment.

The hair to be treated is wound on in the usual manner, the strip of preferably thin, liquid-impermeable thermoplastic foil being wound on together therewith and the hair not to be treated being reliably protected beneath the foil. When the aftergrowth of hair is reached, the excess length of the strip can simply be cut off, so that in the continuation of the winding process the hair can no longer move under the foil and is therefore completely accessible for treatment. This is a simple way of preventing pretreated permanently waved hair from being given two aftertreatments or more.

The foil can be attached to a preferably polypropylene or polystyrene winder in the simplest manner by sealing, gluing, stapling or spiking on short pins. A special construction of such winders comprises a combined jacketing with adhesive ribbon and a strip of foil attached thereto.

According to a feature of the invention, the strip of foil is attached by one of its narrow edges to the winding member or spool and is disposed between heads of larger diameter at the two ends of the spool. The strip is preferably rectangular with its length extending from the shank of the spool between the two heads and the foil can be attached to the spool by heat sealing, gluing or adhesive application, stapling, hooking or even by a Velcro (hook and loop) fastener.

According to this invention, moreover, an adhesive strip is disposed on the spool for the attachment of the strip of foil which preferably is a thin thermoplastic member, e.g. of polyethylene, polypropylene or polyvinylchloride. The winding member or spool can be enclosed by an adhesive ribbon having projecting hooks, pins or bristles.

The adhesive ribbon can project laterally in the form of a strip beyond the spool and can extend substantially parallel to the strip of foil.

In a preferred embodiment of the invention the adhesive ribbon can have a length similar to the strip of foil. The outside of foil strip can have an adhesive zone, more particularly, a region provided with projecting hooks, pins and/or bristles. The strip of foil can be composed of relatively stiff adhesive ribbon having at least one turn forming the spool. A rear side of the adhesive ribbon can be rendered impermeable to liquid by coating or lamination with thermoplastic foil where a nylon ribbon forms the strip and is permeable to air and liquids. The ribbon can have a surface formed with nylon adhesive hooks or mushroom strapped adhesive bristles.

BRIEF DESCRIPTION OF THE DRAWING

The above and other objects, features, and advantages will become more readily apparent from the following description, reference being made to the accompanying drawing in which:

FIG. 1 is a plan view of a permanent wave winder with a strip of foil attached thereto according to the invention;

FIG. 2 is a plan view of a permanent wave winder jacketed with adhesive ribbon and a strip of foil attached thereto;

FIG. 3 is an elevational view of a permanent wave winder with an adhesive strip for the attachment of a strip of foil, for use both with and without a strip of foil;

SPECIFIC DESCRIPTION

Figure 4:
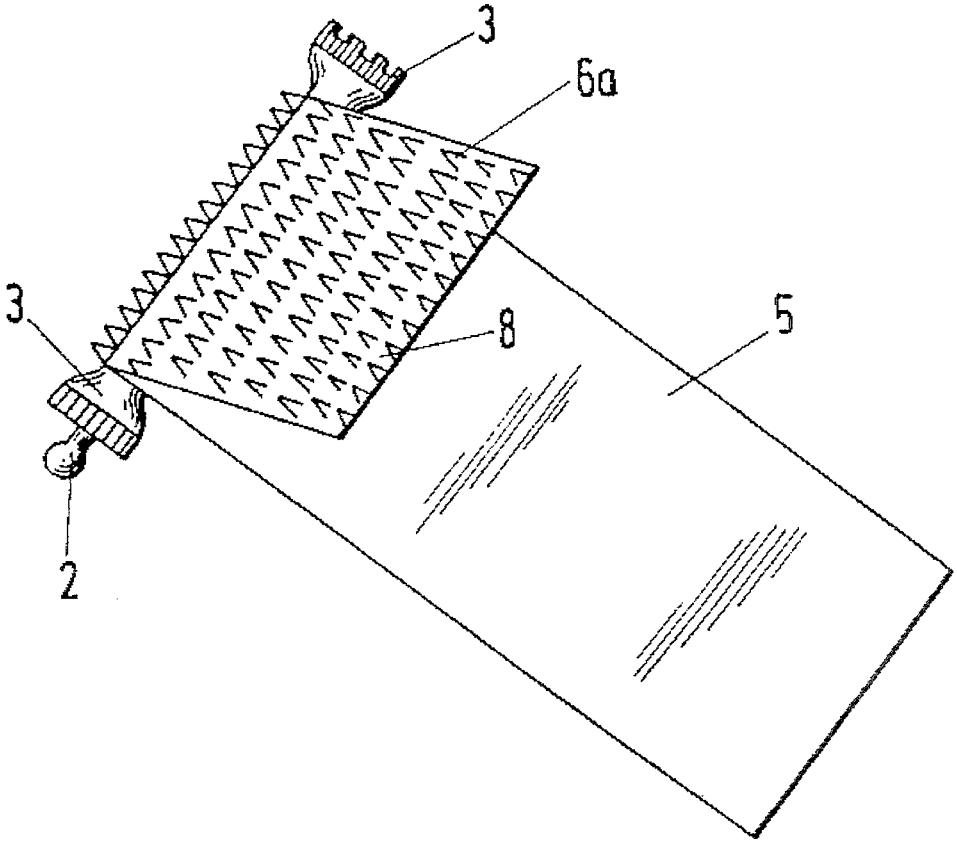
FIG. 4 is a perspective view of a permanent wave winder in which the adhesive ribbon jacketing is extended to a portion of foil, together with a strip of foil.

A hair winder has a winding member or spool 1 with each of whose ends an enlarged head 3 is integral, one head having a coaxially projecting knob 2 onto which a rubber band is looped which can be releasably attached by its other end in notches in the opposite head to retain the winder after a lock of hair has been wound thereon.

A rectangular strip of foil 5, e.g. a polyethylene foil, is attached by its shorter traverse side 5*a* to the winding member 1 axis parallel between the two heads 3 on the jacket-shaped outside (FIG. 1).

The flag-shaped strip of foil 5 has, as a rule, a greater length L than width B, to enable a sufficiently long zone of hair to be enveloped and thereby covered by the strip of foil 5. The length L of the strip of foil 5 can be shortened as required. The strip of foil preferably consists of a thin, thermoplastic foil.

As shown in FIG. 2, the winding member 1 is enclosed by an adhesive ribbon 6 from whose outside hooks, pins and/or bristles 6*a* project. In the embodiment shown in FIG. 2 the adhesive ribbon 6 encloses only the outside of the winding member 1 and does not project. In contrast, in the embodiment illustrated in FIG. 4 the adhesive ribbon forms a second strip 8 which projects laterally beyond the winding member and which can preferably lie parallel with the strip of foil 5 and therefore be wound on with said strip. The adhesive ribbon 8 has a shorter length than the strip of foil 5.

In another, alternative embodiment the outside of the strip of foil 5 has an adhesive zone, more particularly with projecting hooks, pins and/or bristles. The strip of foil can also consist of a relatively stiff material, so that it forms the winding member at the same side. As a result of coating or by lamination with thermoplastic foil, the rear side of the adhesive ribbon is also liquid-impermeable.

Figure 5:
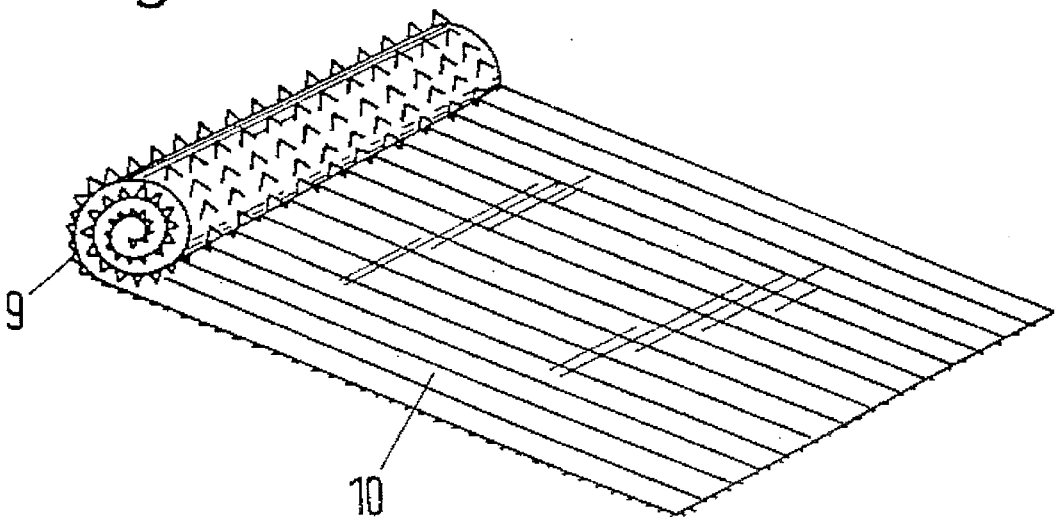
FIG. 5 is a perspective view of a permanent wave winder in which solely the adhesive ribbon performs the function of the spooler.

In the embodiment shown in FIG. 5 there is no actual separate spool, but a winding member is formed by an initial turn or turns of a winding of the strip of foil and/or the adhesive ribbon; here again the outside is provided with an adhesive zone with hooks, pins and/or bristles. The strip of foil and/or the adhesive ribbon can be a foil laminate.

In the embodiment illustrated in FIG. 5, therefore, more particularly in combination with a coating or a foil laminate, the adhesive ribbon forms a roll of foil or ribbon which takes over the complete function of the hair winder.

In the case of the hair winders of FIGS. 1 and 2, a lock of hair to be treated with the solution or gel utilized for permanent waving, is placed on the roller 1 which is coiled to wind the free end of the lock of hair inwardly of the foil strip 5 until the only part remaining is the section of hair adjoining the roots which has not been treated previously with the permanent waving solution. At that point, the balance of the strip 5 is cut off and winding continued for a loose or tight curl as the user desires and the curler is held in place by looping a rubber band around the knob 2 and into the notches of the crenolated head 3 at the opposite end of the curler from the knob 2. After the hair curlers are placed over the entire head as may be desired, the hair that is exposed at each hair curler is only the length which has grown in since a prior waving and the hair can be treated with the permanent waving solution. Since the inner turns on each curler are protected by the liquid impermeable strip 5, previously treated hair is not subjected to a detrimental subsequent treatment. However, untreated hair is permanently waved with the applied perm solution and fixation. The hair can then be rinsed in the usual manner after the curlers have been removed.

The embodiment of FIGS. 4 and 5 are used similarly except that retention may be effected by the hook and loop fasteners and rubber bands may not be necessary to retain the curlers in place. Key to the invention, of course, is that it interposes a liquid impermeable strip between previously treated hair and hair to be treated in a subsequent application.

I claim:

1. A hair winder comprising:

a winding member onto which a lock of hair can be wound;

a strip of foil being attached by one edge to the winding member, the edge extending between two heads of the winding member so that the strip can be wound onto the winding member together with the lock of hair; and a self-gripping ribbon having projections enclosing the winding member and projecting laterally in the form of a strip beyond the winding member and extending substantially parallel with a strip of foil.

2. The hair winder according to claim 1 wherein the self-gripping ribbon has a smaller length than the strip of foil.

3. The hair winder according to claim 1 wherein the self-gripping ribbon is in the form of a nylon ribbon which is permeable to air and liquids and whose surface is formed with nylon self-gripping hooks or mushroom-shaped nylon bristles.

4. The hair winder according to claim 1 wherein the strip of foil consists of a thin thermoplastic foil.

5. The hair winder according to claim 1, wherein said projections are selected from the group consisting of hooks, pins and bristles.

* * * * *